US009316166B2

(12) United States Patent
Miller et al.

(10) Patent No.: US 9,316,166 B2
(45) Date of Patent: Apr. 19, 2016

(54) SYSTEM AND METHOD FOR CONTROLLING AN OPERATING FREQUENCY OF A PURGE VALVE TO IMPROVE FUEL DISTRIBUTION TO CYLINDERS OF AN ENGINE

(71) Applicant: GM Global Technology Operations LLC, Detroit, MI (US)

(72) Inventors: Jon C. Miller, Fenton, MI (US); Scott Jeffrey, Hartland, MI (US); David Edward Prout, Linden, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 205 days.

(21) Appl. No.: 13/832,558

(22) Filed: Mar. 15, 2013

(65) Prior Publication Data

US 2014/0278001 A1 Sep. 18, 2014

(51) Int. Cl.
*F02D 41/00* (2006.01)
*F02D 41/20* (2006.01)

(52) U.S. Cl.
CPC ..... *F02D 41/0097* (2013.01); *F02D 41/004* (2013.01); *F02D 2041/2027* (2013.01); *F02D 2200/101* (2013.01)

(58) Field of Classification Search
CPC ..... F02D 41/004; F02D 41/0045; F02D 41/0032; F02D 41/0042; F02D 2041/2027; F02D 2200/602; F02D 41/04; F02D 41/00; F02D 41/0097; F02M 25/08; F02P 5/045
USPC ..... 123/339.12, 339.14, 339.2, 344, 350, 123/353, 354, 355, 356, 405, 704, 438, 443, 123/453, 461, 516, 518, 519, 520; 701/103; 361/679.34, 3, 111, 96, 97, 143, 152, 361/160, 166, 167, 168.1, 169.1, 170, 182, 361/183, 203, 243, 244, 265
See application file for complete search history.

(56) References Cited

U.S. PATENT DOCUMENTS 4,495,921 A * 1/1985 Sawamoto ..... F02D 41/04 123/438
5,054,454 A * 10/1991 Hamburg ..... F02D 41/004 123/520
5,353,770 A * 10/1994 Osanai ..... F02M 25/08 123/520
5,368,002 A * 11/1994 Hoshino ..... F02D 41/0045 123/198 D
5,445,132 A * 8/1995 Isobe ..... F02D 41/004 123/198 D
5,596,972 A * 1/1997 Sultan ..... F02D 41/0045 123/520
5,606,955 A * 3/1997 Yuda ..... F02D 41/004 123/520
5,609,142 A * 3/1997 Osanai ..... F02D 41/004 123/357
5,634,451 A * 6/1997 Tomisawa ..... F02D 41/004 123/516
5,699,778 A * 12/1997 Muraguchi ..... F02D 41/0032 123/520
5,706,789 A * 1/1998 Yamada ..... F02D 41/004 123/520
5,735,251 A * 4/1998 Hyodo ..... F02D 41/004 123/518
5,746,187 A * 5/1998 Ninomiya ..... F02D 41/0032 123/520
5,778,867 A * 7/1998 Osanai ..... F02D 41/004 123/520
5,806,501 A * 9/1998 Osanai ..... F02M 25/08 123/520
5,862,795 A * 1/1999 Osanai ..... F02D 41/004 123/520
5,884,610 A * 3/1999 Reddy ..... F02D 41/0045 123/520
6,044,831 A * 4/2000 Takagi ..... F02D 41/0032 123/520
6,069,783 A * 5/2000 Mount ..... F02D 41/004 123/490

(Continued)

*Primary Examiner* — Hai Huynh
*Assistant Examiner* — John Bailey

(57) ABSTRACT

A system according to the principles of the present disclosure includes an engine speed module and a valve control module. The engine speed module determines a speed of an engine based on a position of a crankshaft. The valve control module selectively adjusts an operating frequency of a purge valve based on the engine speed.

22 Claims, 5 Drawing Sheets

(56) References Cited

U.S. PATENT DOCUMENTS 6,196,203 B1 * 3/2001 Grieve ..... F02M 25/08 123/198 D
6,305,360 B1 * 10/2001 Hurley ..... F02D 41/0032 123/516
6,321,735 B2 * 11/2001 Grieve ..... 123/520
6,729,312 B2 * 5/2004 Furushou ..... F02D 41/0032 123/520
7,007,684 B2 * 3/2006 Itakura ..... F02D 41/0042 123/520
7,021,046 B2 * 4/2006 Surnilla ..... F02D 41/0082 123/481
7,059,298 B2 * 6/2006 Ozaki ..... F02D 41/0032 123/325
7,497,074 B2 * 3/2009 Surnilla ..... F02D 41/0087 123/520
7,603,990 B2 * 10/2009 Takakura ..... F02D 41/0042 123/520
7,610,906 B2 * 11/2009 Takakura ..... F02M 25/089 123/520
7,942,134 B2 * 5/2011 Peters ..... F02D 41/0032 123/520
8,942,846 B2 * 1/2015 Jacobsen ..... B25J 3/04 700/245
2001/0032637 A1 * 10/2001 Grieve ..... F02D 41/0045 123/674
2003/0000489 A1 * 1/2003 Majima ..... F01L 1/34 123/90.17
2003/0047161 A1 * 3/2003 Bagnasco ..... F02D 41/0032 123/295
2003/0051715 A1 * 3/2003 Bagnasco ..... F02M 25/089 123/698
2004/0011339 A1 * 1/2004 Sanchez ..... F02D 41/004 123/520
2004/0094133 A1 * 5/2004 Lingenhult ..... F02M 25/0809 123/519
2005/0193719 A1 * 9/2005 Sumilla ..... F02D 41/0082 60/285
2005/0193720 A1 * 9/2005 Surnilla ..... F02D 41/0082 60/285
2005/0193986 A1 * 9/2005 Cullen ..... F02D 41/0082 123/478
2005/0193988 A1 * 9/2005 Bidner ..... F01L 13/00 123/481
2005/0193997 A1 * 9/2005 Cullen ..... F02D 41/0087 123/698
2005/0197759 A1 * 9/2005 Surnilla ..... F02P 5/1504 701/103
2005/0197761 A1 * 9/2005 Bidner ..... F02P 5/045 701/105
2005/0284445 A1 * 12/2005 Ozaki ..... F02D 41/0032 123/325
2010/0108030 A1 * 5/2010 Kusaka ..... F02D 31/007 123/357
2010/0246086 A1 * 9/2010 Ishiguro ..... H01F 7/18 361/160
2013/0019454 A1 1/2013 Colombo et al.

* cited by examiner

SYSTEM AND METHOD FOR CONTROLLING AN OPERATING FREQUENCY OF A PURGE VALVE TO IMPROVE FUEL DISTRIBUTION TO CYLINDERS OF AN ENGINE

FIELD

The present disclosure relates to internal combustion engines, and more specifically, to systems and methods for controlling an operating frequency of a purge valve to improve fuel distribution to cylinders of an engine.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

SUMMARY

A system according to the principles of the present disclosure includes an engine speed module and a valve control module. The engine speed module determines a speed of an engine based on a position of a crankshaft. The valve control module selectively adjusts an operating frequency of a purge valve based on the engine speed.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A fuel system may include a fuel tank and an evaporative emissions (EVAP) system that collects fuel vapor from the fuel tank and selectively provides the fuel vapor to the engine, which combusts the fuel vapor. The EVAP system may include a canister, a vent valve, and a purge valve. The canister adsorbs fuel vapor from a fuel tank. The vent valve allows ambient air to enter the canister when the vent valve is open. The purge valve allows fuel vapor to flow from the canister to an intake system of the engine. A vacuum in the intake system may draw fuel vapor from the canister to the intake system when the vent valve is open to allow airflow through the canister and the purge valve is open to allow the fuel vapor to enter the intake system. Thus, instead of venting fuel vapor from the fuel tank directly into the atmosphere, the fuel vapor is combusted in the engine, which reduces emissions and improves fuel economy.

The purge valve opens and closes based on a frequency and a duty cycle of its voltage supply. Occasionally, the frequency at which the engine completes one revolution may be equal to a harmonic of an operating frequency of the purge valve. When this occurs, the opening timing of the purge valve may correspond to the opening timing of an intake valve of a cylinder of the engine. In turn, the cylinder may ingest a majority of the fuel vapor that flows through the purge valve. As exhaust is expelled from the cylinder, an oxygen sensor in an exhaust system of the engine may indicate that an air/fuel ratio of the engine is rich. In turn, the amount of fuel provided to the cylinders may be reduced, causing the air/fuel ratio of the engine to be more lean than desired.

A system and method prevents this maldistribution of fuel to cylinders of an engine by adjusting an operating frequency of a purge valve based on engine speed. In one example, the system and method adjusts the operating frequency of the purge valve when the engine speed is within a predetermined range of a speed that corresponds to a harmonic of the operating frequency of the purge valve. In another example, the system and method converts the engine speed into a frequency and adjusts the operating frequency of the purge valve when the frequency of the engine is within a predetermined range of a harmonic of the operating frequency. In either example, the system and method may adjust the operating frequency of the purge valve by decreasing or increasing the operating frequency by a predetermined amount.

Figure 1:
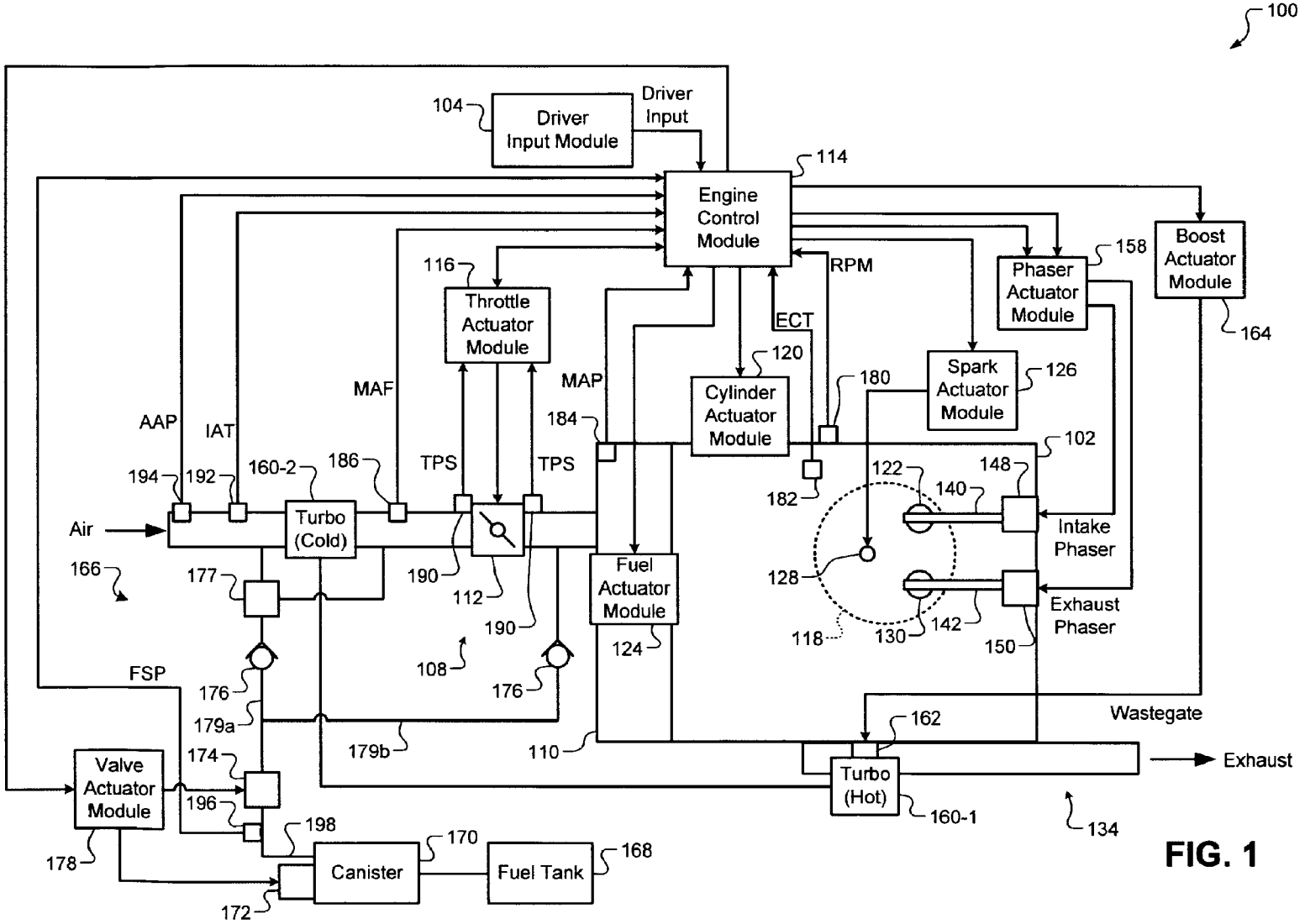
FIG. 1 is a functional block diagram of an example engine system according to the principles of the present disclosure.

Referring to FIG. 1, an engine system 100 includes an engine 102 that combusts an air/fuel mixture to produce drive torque for a vehicle based on driver input from a driver input module 104. The driver input may be based on a position of an accelerator pedal. The driver input may also be based on a cruise control system, which may be an adaptive cruise control system that varies vehicle speed to maintain a predetermined following distance.

Air is drawn into the engine 102 through an intake system 108. The intake system 108 includes an intake manifold 110 and a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations, fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, the combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The cylinder actuator module 120 may deactivate the cylinder 118 by disabling opening of the intake valve 122 and/or the exhaust valve 130. In various implementations, the intake valve 122 and/or the exhaust valve 130 may be controlled by devices other than camshafts, such as electromagnetic or electrohydraulic actuators.

The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift may also be controlled by the phaser actuator module 158.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2, driven by the turbine 160-1, that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. The compressed air charge may also have absorbed heat from components of the exhaust system 134. Although shown separated for purposes of illustration, the turbine 160-1 and the compressor 160-2 may be attached to each other, placing intake air in close proximity to hot exhaust.

The engine 102 combusts fuel provided by a fuel system 166. The fuel system 166 includes a fuel tank 168, a canister 170, a vent valve 172, a purge valve 174, check valves 176, and a jet pump 177. The canister 170 adsorbs fuel from the fuel tank 168. The vent valve 172 allows atmospheric air to enter the canister 170 when the vent valve 172 is open. The purge valve 174 allows fuel vapor to flow from the canister 170 to the intake system 108 when the purge valve 174 is open. The check valves 176 prevent flow from the intake system 108 to the canister 170. The ECM 114 controls a valve actuator module 178, which regulates operating frequencies and duty cycles of the vent valve 172 and the purge valve 174.

The ECM 114 may open the vent valve 172 and the purge valve 174 to purge fuel vapor from the canister 170 to the intake system 108.

Fuel vapor flows from the canister 170 to the intake system 108 through a first flow path 179*a* or a second flow path 179*b*. When the boost device is operating (e.g., when the wastegate 162 is closed), the pressure at the outlet of the first flow path 179*a* is less than the pressure at the outlet of the second flow path 179*b*. Thus, fuel vapor flows from the canister 170 to the intake system 108 through the first flow path 179*a*. When the boost device is not operating (e.g., when the wastegate 162 is open), the pressure at the outlet of the first flow path 179*a* is greater than the pressure at the outlet of the second flow path 179*b*. Thus, fuel vapor flows from the canister 170 to the intake system 108 through the second flow path 179*b*.

When the boost device is operating, the pressure of intake air upstream from the compressor 160-2 is less than the pressure of intake air downstream from the compressor 160-2. The jet pump 177 utilizes this pressure difference to create a vacuum that draws fuel vapor from the canister 170 into the intake system 108. The fuel vapor flows through the jet pump 177 and enters the intake system 108 upstream from the compressor 160-2.

The engine system 100 may measure the position of the crankshaft using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The temperature of ambient air being drawn into the engine 102 may be measured using an intake air temperature (IAT) sensor 192. The pressure of ambient air being drawn into the engine 102 may be measured using an ambient air pressure (AAP) sensor 194. The pressure within the fuel system 166 may be measured using a fuel system pressure (FSP) sensor 196. The FSP sensor 196 may be located in a line 198 extending between the canister 170 and the purge valve 174, as shown, or in the canister 170.

The ECM 114 may use signals from the sensors to make control decisions for the engine system 100. The ECM 114 may the operating frequency of the purge valve 174 when a speed of the engine 102 is within a predetermined range of a speed that corresponds to a harmonic of the operating frequency of the purge valve 174. The ECM 114 may convert the engine speed into a frequency and adjust the operating frequency of the purge valve 174 when the frequency of the engine 102 is within a predetermined range of a harmonic of the operating frequency of the purge valve 174.

Figure 2:
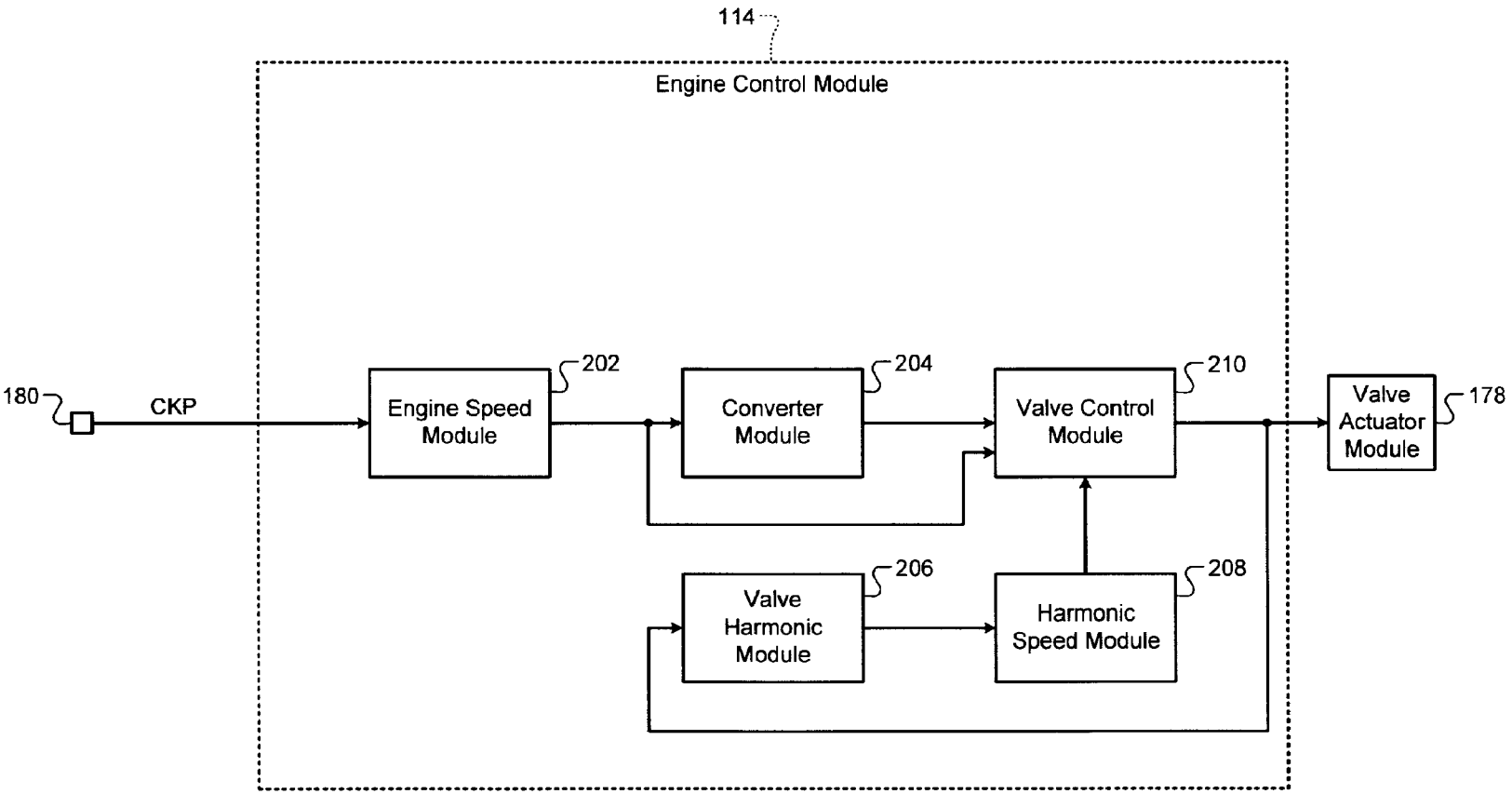
FIG. 2 is a functional block diagram of an example control system according to the principles of the present disclosure.

Referring to FIG. 2, an example implementation of the ECM 114 includes an engine speed module 202, a converter module 204, a valve harmonic module 206, a harmonic speed module 208, and a valve control module 210. The engine speed module 202 determines engine speed. The engine speed module 202 may determine the engine speed based on the crankshaft position from the CKP sensor 180. For example, the engine speed module 202 may determine the engine speed based on a period of crankshaft rotation corresponding to a number of tooth detections. The engine speed module 202 outputs the engine speed.

The converter module 204 converts the engine speed into a frequency. For example, when the engine speed is determined in revolutions per minute (RPM), the converter module 204 may divide the engine speed by 60 to obtain the frequency of the engine 102. Thus, the frequency of the engine 102 may be 16 Hertz (Hz) when the engine speed is 960 RPM, and the frequency of the engine 102 may be 32 Hz when the engine speed is 1920 RPM. The converter module 204 outputs the frequency of the engine 102.

The valve harmonic module 206 determines harmonics of the operating frequency of the purge valve 174. The valve harmonic module 206 may determine the harmonics by multiplying the operating frequency by an integer. For example, the valve harmonic module 206 may determine that an operating frequency of 16 Hz has a first harmonic of 16 Hz and a second harmonic of 32 Hz. The valve harmonic module 206 may determine a predetermined number of harmonics for each operating frequency. The valve harmonic module 206 outputs the harmonics of the operating frequency.

The harmonic speed module 208 determines engine speeds that correspond to the harmonics of the operating frequency of the purge valve 174. The harmonic speed module 208 may determine the engine speeds in revolutions per minute by multiplying the harmonics by 60. For example, the harmonic speed module 208 may determine that a first harmonic of 16 Hz corresponds to an engine speed of 960 RPM. In another example, the harmonic speed module 208 may determine that a second harmonic of 32 Hz corresponds to an engine speed of 1920 RPM.

The valve control module 210 controls the purge valve 174 by sending a signal to the valve actuator module 178 indicating the operating frequency of the purge valve 174 and the duty cycle of the purge valve 174. The valve control module 210 may maintain the operating frequency at a predetermined frequency (e.g., 16 Hz) when the engine speed does not correspond to a harmonic of the operating frequency. The valve control module 210 may then adjust the operating frequency when the engine speed corresponds to a harmonic of the operating frequency.

In one example, the valve control module 210 adjusts the operating frequency when the engine speed is within a predetermined range (e.g., +/−100 RPM) of a speed that corresponds to a harmonic of the operating frequency. In another example, the valve control module 210 adjusts the operating frequency of the purge valve 174 when the frequency of the engine 102 is within a predetermined range (e.g., +/−3 Hz) of a harmonic of the operating frequency. In either example, the valve control module 210 may not adjust the operating frequency when the duty cycle of the purge valve 174 is greater than or equal to a predetermined percentage (e.g., 100 percent (%)).

In addition, in each of the above examples, the valve control module 210 may adjust the operating frequency of the purge valve 174 to a first frequency. The valve control module 210 may select the first frequency to ensure that the frequency of the engine 102 is outside of a predetermined range (e.g., +/−3 Hz) of all harmonics of the operating frequency of the purge valve 174 when the operating frequency is adjusted to the first frequency. Additionally or alternatively, the valve control module 210 may adjust the operating frequency of the purge valve 174 by increasing or decreasing the operating frequency by a predetermined amount (e.g., 3 Hz).

Figure 3:
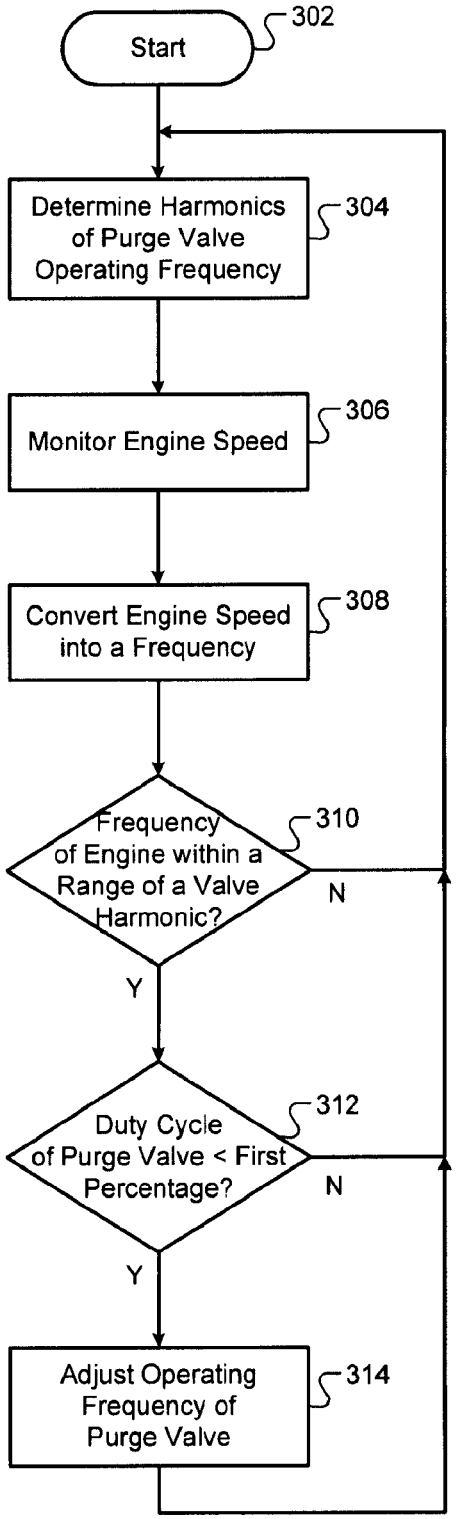
FIGS. 3 and 4 are flowcharts illustrating example control methods according to the principles of the present disclosure.

Referring to FIG. 3, a first method for controlling an operating frequency of a purge valve to improve fuel distribution to cylinders of an engine begins at 302. At 304, the method determines harmonics of the operating frequency of the purge valve. The method may determine the harmonics by multiplying the operating frequency by an integer. For example, the method may determine that an operating frequency of 16 Hz has a first harmonic of 16 Hz and a second harmonic of 32 Hz. The method may determine a predetermined number of harmonics for each operating frequency.

At 306, the method monitors engine speed. The method may determine the engine speed based on a crankshaft position measured by a crankshaft position sensor. For example, the method may determine the engine speed based on a period corresponding to a number of tooth detections.

At 308, the method converts the engine speed into a frequency. For example, when the engine speed is determined in revolutions per minute, the method may divide the engine speed by 60 to obtain the frequency of the engine. Thus, the frequency of the engine may be 16 Hz when the engine speed is 960 RPM, and the frequency of the engine may be 32 Hz when the engine speed is 1920 RPM.

At 310, the method determines whether the frequency of the engine is within a predetermined range (e.g., +/−3 Hz) of any of the harmonics of the operating frequency of the purge valve. If the frequency of the engine is within the predetermined range of any of the harmonics, the method continues at 312. Otherwise, the method continues at 304.

At 312, the method determines whether a duty cycle of the purge valve is less than a first percentage (e.g., 100%). The first percentage may be predetermined. If the duty cycle of the purge valve is less than the first percentage, the method continues at 314. Otherwise, the method continues at 304.

At 314, the method adjusts the operating frequency of the purge valve. The method may adjust the operating frequency of the purge valve by increasing or decreasing the operating frequency by a predetermined frequency (e.g., 3 Hz). Additionally or alternatively, the method may adjust the operating frequency of the purge valve to a first frequency. The method may select the first frequency to ensure that the frequency of the engine is outside of a predetermined range (e.g., +/−3 Hz) of the operating frequency of the purge valve when the operating frequency is adjusted to the first frequency.

Figure 4:
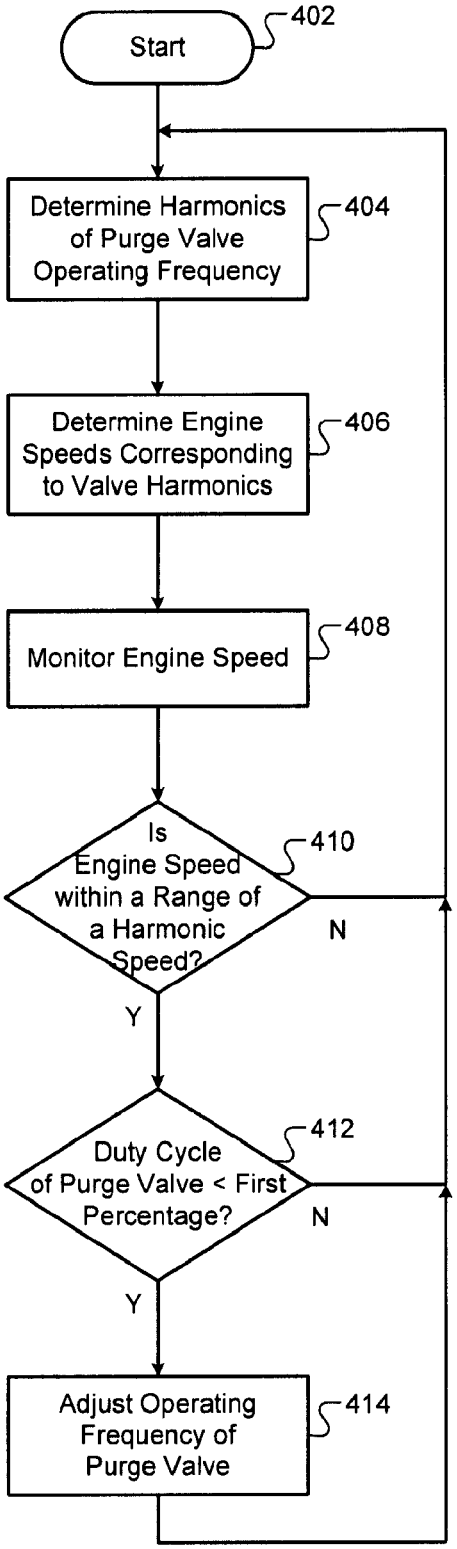

Referring to FIG. 4, a second method for controlling an operating frequency of a purge valve to improve fuel distribution to cylinders of an engine begins at 402. At 404, the method determines harmonics of the operating frequency of the purge valve. The method may determine the harmonics by multiplying the operating frequency by an integer. For example, the method may determine that an operating frequency of 16 Hz has a first harmonic of 16 Hz and a second harmonic of 32 Hz. The method may determine a predetermined number of harmonics for each operating frequency.

At 406, the method determines engine speeds that correspond to the harmonics of the operating frequency of the purge valve. The method may determine the engine speeds in revolutions per minute by multiplying the harmonics by 60. For example, the method may determine that a first harmonic of 16 Hz corresponds to an engine speed of 960 RPM. In another example, the method may determine that a second harmonic of 32 Hz corresponds to an engine speed of 1920 RPM.

At 408, the method monitors engine speed. The method may determine the engine speed based on a crankshaft position measured by a crankshaft position sensor. For example, the method may determine the engine speed based on a period corresponding to a number of tooth detections.

At 410, the method determines whether the engine speed is within a predetermined range (e.g., +/−100 RPM) of the engine speeds that correspond to the harmonics of the operating frequency. If the engine speed is within the predetermined range of the engine speeds that correspond to the harmonics of the operating frequency, the method continues at 412. Otherwise, the method continues at 404.

At 412, the method determines whether a duty cycle of the purge valve is less than a first percentage (e.g., 100%). The first percentage may be predetermined. If the duty cycle of the purge valve is less than the first percentage, the method continues at 414. Otherwise, the method continues at 404.

At 414, the method adjusts the operating frequency of the purge valve. The method may adjust the operating frequency of the purge valve by increasing or decreasing the operating frequency by a predetermined frequency (e.g., 3 Hz). Additionally or alternatively, the method may adjust the operating frequency of the purge valve to a first frequency. The method may select the first frequency to ensure that the frequency of the engine is outside of a predetermined range (e.g., +/−3 Hz) of the operating frequency when the operating frequency is adjusted to the first frequency.

Figure 5:
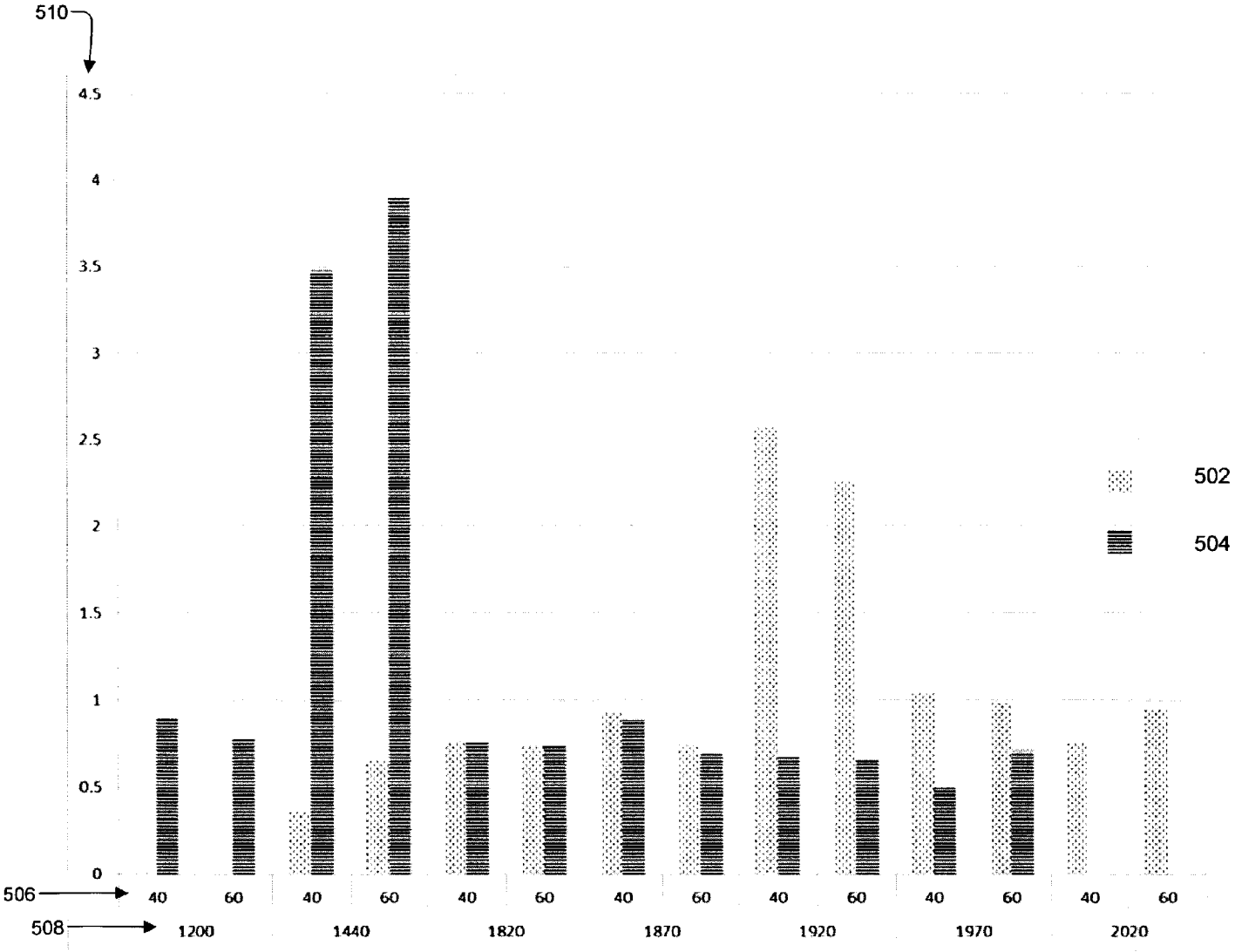
FIG. 5 is a graph illustrating differences in air/fuel ratios of different cylinders of an engine at various levels of engine speed and engine vacuum.

Referring to FIG. 5, a graph illustrates the relationship between engine speed, engine vacuum, an operating frequency of a purge valve, and the distribution of purge fuel vapor to cylinders of an engine. A maldistribution of purge fuel vapor to the cylinders of the engine when the purge valve is operating at a frequency of 16 Hz is illustrated at 502. A maldistribution of purge fuel vapor to the cylinders of the engine when the purge valve is operating at a frequency of 12 Hz is illustrated at 504. The engine has four cylinders, and the purge valve is operating at a duty cycle of 30%.

A first set of numbers 506 along the x-axis represents engine vacuum in kilopascals (kPa). A second set of numbers 508 along the x-axis represents engine speed in RPM. A third set of numbers 510 along the y-axis represents the magnitudes of the maldistributions.

A system and method according to the present disclosure determines the maldistributions 502, 504 in three steps. First, the system and method calculates an average air/fuel ratio of the cylinders over a period. Second, the system and method calculates a difference between an average air/fuel ratio of each cylinder over the period and the average air/fuel ratio of all of the cylinders over the period. Third, the system and method calculates a sum of the differences.

A purge valve regulates the flow of fuel vapor from a canister to the engine. When the purge valve operates at a frequency of 16 Hz, first and second harmonics of the operating frequency of the purge valve are 16 Hz and 32 Hz respectively. In addition, engine speeds that correspond to the first and second harmonics are 960 RPM and 1920 RPM, respectively. When the purge valve operates at a frequency of 12 Hz, first and second harmonics of the operating frequency of the purge valve are 12 Hz and 24 Hz respectively. In addition, engine speeds that correspond to the first and second harmonics are 720 RPM and 1440 RPM, respectively.

The highest peak in the maldistribution 502 occurs at 1920 RPM, the engine speed that corresponds to the second harmonic when the purge valve is operating at 16 Hz. The highest peak in the maldistribution 504 occurs at 1440 RPM, the engine speed that corresponds to the second harmonic when the purge valve is operating at 12 Hz. Thus, regardless of whether the operating frequency of a purge valve is 16 Hz or 12 Hz, the maldistribution of purge fuel vapor to cylinders of an engine increases when the engine speed corresponds to a harmonic of the operating frequency.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

an engine speed module that determines a speed of an engine based on a position of a crankshaft; and a valve control module that selectively adjusts an operating frequency of a purge valve to a first frequency when the engine speed corresponds to a harmonic of the operating frequency of the purge valve, wherein the engine speed does not correspond to a harmonic of the first frequency.

2. The system of claim 1 further comprising a harmonic speed module that determines a first speed of the engine that corresponds to the harmonic of the operating frequency of the purge valve, wherein the valve control module adjusts the operating frequency of the purge valve when the engine speed is equal to the first speed.

3. The system of claim 2 wherein the valve control module adjusts the operating frequency of the purge valve when the engine speed is within a predetermined range of the first speed.

4. The system of claim 3 wherein the valve control module decreases the operating frequency of the purge valve by a predetermined amount when the engine speed is within the predetermined range of the first speed.

5. The system of claim 3 wherein the valve control module maintains the operating frequency of the purge valve at a predetermined frequency when the engine speed is outside of the predetermined range of the first speed.

6. The system of claim 1 wherein the valve control module:

adjusts the operating frequency of the purge valve to the first frequency when a frequency corresponding to the engine speed is within a predetermined range of the harmonic of the operating frequency of the purge valve; and selects the first frequency such that the frequency corresponding to the engine speed is outside of a predetermined range of harmonics of the operating frequency of the purge valve when the operating frequency is adjusted to the first frequency.

7. The system of claim 1 further comprising a converter module that converts the engine speed into a frequency of the engine, wherein the valve control module adjusts the operating frequency of the purge valve when the frequency of the engine is within a predetermined range of a harmonic of the operating frequency of the purge valve.

8. The system of claim 1 further comprising a valve harmonic module that determines harmonics of the operating frequency of the purge valve, wherein the valve control module adjusts the operating frequency of the purge valve when a frequency corresponding to the engine speed is within a predetermined range of one of the harmonics.

9. The system of claim 1 wherein the valve control module selectively adjusts the operating frequency of the purge valve further based on a duty cycle of the purge valve.

10. The system of claim 9 wherein the valve control module selectively adjusts the operating frequency of the purge valve based on the engine speed when the duty cycle of the purge valve is less than a predetermined percentage.

11. A method comprising:

determining a speed of an engine based on a position of a crankshaft; and selectively adjusting an operating frequency of a purge valve to a first frequency when the engine speed corresponds to a harmonic of the operating frequency of the purge valve, wherein the engine speed does not correspond to a harmonic of the first frequency.

12. The method of claim 11 further comprising:

determining a first speed of the engine that corresponds to the harmonic of the operating frequency of the purge valve; and adjusting the operating frequency of the purge valve when the engine speed is equal to the first speed.

13. The method of claim 12 further comprising adjusting the operating frequency of the purge valve when the engine speed is within a predetermined range of the first speed.

14. The method of claim 13 further comprising decreasing the operating frequency of the purge valve by a predetermined amount when the engine speed is within the predetermined range of the first speed.

15. The method of claim 13 further comprising maintaining the operating frequency of the purge valve at a predetermined frequency when the engine speed is outside of the predetermined range of the first speed.

16. The method of claim 11 further comprising:

adjusting the operating frequency of the purge valve to the first frequency when a frequency corresponding to the engine speed is within a predetermined range of the harmonic of the operating frequency of the purge valve; and selecting the first frequency such that the frequency corresponding to the engine speed is outside of a predetermined range of harmonics of the operating frequency of the purge valve when the operating frequency is adjusted to the first frequency.

17. The method of claim 11 further comprising:

converting the engine speed into a frequency of the engine; and adjusting the operating frequency of the purge valve when the frequency of the engine is within a predetermined range of a harmonic of the operating frequency of the purge valve.

18. The method of claim 11 further comprising:

determining harmonics of the operating frequency of the purge valve; and adjusting the operating frequency of the purge valve when a frequency corresponding to the engine speed is within a predetermined range of one of the harmonics.

19. The method of claim 11 further comprising selectively adjusting the operating frequency of the purge valve further based on a duty cycle of the purge valve.

20. The method of claim 19 further comprising selectively adjusting the operating frequency of the purge valve based on the engine speed when the duty cycle of the purge valve is less than a predetermined percentage.

21. The system of claim 1 wherein the harmonic of the operating frequency of the purge valve includes a frequency other than the operating frequency.

22. The method of claim 11 wherein the harmonic of the operating frequency of the purge valve includes a frequency other than the operating frequency.

* * * * *